United States Patent [19]

Famolare, Jr.

[11] 4,258,480

[45] Mar. 31, 1981

[54] RUNNING SHOE

[75] Inventor: Joseph P. Famolare, Jr., Putney, Vt.

[73] Assignee: Famolare, Inc., New York, N.Y.

[21] Appl. No.: 931,016

[22] Filed: Aug. 4, 1978

[51] Int. Cl.[3] ..... A43B 7/22; A43B 7/14

[52] U.S. Cl. ..... 36/91; 128/586

[58] Field of Search ..... 36/91, 43, 44, 129; 128/166.5, 586, 80 D

[56] References Cited

U.S. PATENT DOCUMENTS

| | | | |
|---|---|---|---|
| 2,075,552 | 3/1937 | Stemmons | 36/91 |
| 3,414,988 | 12/1968 | Mattos | 36/91 |
| 3,716,930 | 2/1973 | Brahm | 36/3 B |
| 4,033,054 | 7/1977 | Fukuoka | 36/91 |
| 4,112,600 | 9/1978 | Hayward | 36/91 |

*Primary Examiner*—Patrick D. Lawson

*Attorney, Agent, or Firm*—Mandeville and Schweitzer

[57] ABSTRACT

Disclosed herein is a new and improved running shoe in which the structure and anatomy of the shoe, including the upper and the thermoplastic rubber unit bottom to which it is secured is balanced and synchronized with the complex action of the wearer's foot in order to tend to optimize the functioning of the multitudinous bones and muscles of the foot and leg during running movements, in general, and during the mid-stance period of the running gait in particular. The unit bottom of the new running shoe has a specially configured and contoured plantar surface having a narrow throat portion with specially shaped integral medial and lateral pad portions disposed therein intermediately of the anterior and posterior portions thereof. The dorsal surface of the new unit sole is generally contoured to conform faithfully to the anatomy of the plantar portion of the wearer's foot when the foot is in its neutral position.

In general, the overall construction of the unit bottom, including its specific geometry and its honeycombed internal support, is arranged to accommodate and to promote proper flexion and extension of the wearer's foot during pronated and supinated movements of the foot and leg during running and striding, and in particular during the "stance" portion of the runner's gait, i.e. the portion of the gait in which the foot is in contact with the ground.

The upper of the new running shoe is of generally ultra-lightweight porous material and reinforced with leather to provide a roomy boxed toe configuration in the distal part and a cushioned, high heel counter portion in the proximal part of the shoe. In addition, an independent heel cushion is interposed between a lightweight insole and the distal dorsal surfaces of the unit bottom. Moreover, cooling channels are formed on the dorsal anterior and posterior surfaces of the unit bottom, which channels communicate with ports exposed to the atmosphere at the leading and trailing edges of the unit bottom to allow for air cooling.

13 Claims, 6 Drawing Figures

RUNNING SHOE

BACKGROUND OF THE INVENTION

The human foot is an extremely complicated biomechanism having 28 bones. These bones are generally grouped in the tarsus (ankle) which includes the talus and calcaneus (heel); the metatarsus which forms (the traverse and longitudinal "arches" of the foot); and the phalanges (toes); and the bones themselves are interconnected through joints operative through 19 muscles, 117 ligaments, and associated nerves, blood vessels, and tissue. The interrelationship of the bones of the foot and the complex biomechanics of the foot during standing, walking and running movements have long been studied and analyzed by the medical profession. In this regard, it is well-known that during walking and running, each foot in action progresses through a series of motions from the moment the heel alone impacts or strikes the ground through a "transitional" or "midstance" phase in which the plantar portions of the foot are generally horizontal and in substantially full contact with the ground through the final propulsive or pushing off phase in which the toes leave the ground as they propel the body forward. Together, the aforementioned three periods of foot contact comprise that phase of the "gait" which is known as the "stance" phase. When the foot is off the ground and moving forward, it is in the other portion of the gait cycle known as the "swing" phase. (See FIG. 6).

It is also well-known that the foot is involved in complex movement about the three body planes when the foot is in the transitional phase of the stance during walking or running.

Specifically the body planes are the horizontal or transverse plane which divides the body into upper and lower portions; the sagittal plane, which divides the body, vertically front-to-back, into right hand and left hand sections; and the frontal plane which divides the body, vertically side-to-side, into anterior and posterior portions. Similarly, three body planes, which are mutually perpendicular, divide each foot as follows:

1. The horizontal plane divides the foot into dorsal (top) and plantar (bottom) portions.
2. The sagittal plane divides the foot into medial (inner) and lateral (outer) portions.
3. The frontal plane divides the foot into distal (furthest from the leg) and proximal (closest to leg) portions.

In connection with each of the body planes there is pure motion of the foot (motion that takes place on one plane with the action of the motion on the other two planes). With regard to the horizontal plane, the foot is subject to abduction and adduction, which are movements of the distal portion of the foot away or toward the midline of the body. With regard to the sagittal plane, the foot is subject to dorsiflexion and plantarflexion involving movement of a part of the entire foot toward or away from the anterior aspect of the leg. With regard to the frontal plane, the foot is subject to inversion and eversion, which motions involve movement of a part of the foot or the whole foot, in which the plantar surface is canted toward or away from the body midline.

In addition to the aforementioned "pure motions" of the foot, namely abduction and adduction; dorsiflexion and plantarflexion; inversion and eversion; the foot is subject to complex motions in which the axis of the motion forms an angle with the three body planes and the motion takes place simultaneously in all of the body planes. This type of motion involves a combination of the aforementioned pure motions and is called "pronation" and "supination".

More specifically, pronation of the foot is a motion which has components in all three body planes, and motion in one of these planes cannot take place independently of the other two. The motion of pronation is a complex motion comprising dorsiflexion, abduction and eversion of the distal on the proximal part. The axis of the motion is an eccentric one which is inclined at an angle to all three body planes, and passes from posterior, plantar and lateral, to anterior, dorsal and medial. In a closed kinetic chain, i.e. during stance, the calcaneus everts with pronation, while the talus adducts and plantarflexes. Additionally, pronation occurs at the midtarsal joint simultaneously due to the forces present on the forefoot. Supination of the foot takes place about the same axis as pronation and consists of a complex motion in a direction opposite to that of pronation, namely; plantarflexion, adduction and inversion of the distal on the proximal parts. In a closed kinetic chain, i.e. during stance, the calcaneus inverts with supination, while the talus abducts and dorsiflexes.

The medical profession and podiatrists have long recognized that comfort, maximum efficiency and preservation of function of the foot are dependent upon the normal progression, distribution and dissipation of the effects of the dynamic forces acting on the skeletal structure of the foot and leg during running and walking. The well-constructed and properly balanced shoe should be in balance with the skeletal-bearing points of the foot and should accommodate and synchronize with its actions. Unfortunately, these criteria in providing comfortable balanced and synchronized shoe constructions have not been widely employed by the shoe industry in the large scale manufacture of footwear by mass production techniques; rather they appear to have been limited mostly to custom made orthopedic shoes. Accordingly, it is to a simplified, efficient, balanced and synchronized running shoe construction, which may be readily mass-produced to which the present invention is directed.

SUMMARY OF THE PRESENT INVENTION

The present invention provides a new and improved running shoe having an upper and unit sole configured to provide substantial and comfortable support to the foot of a wearer as the foot repetitively goes through the phases of a running stride impacting and flexing and extending in rotational and eccentric movements about the three body axes.

The unit sole of the new running shoe is molded in one piece from a resilient thermoplastic rubber material such as "Kraton", which is a springy styrene-butadiene block copolymer produced by Shell Chemical Company. The dorsal surfaces of the unit sole are generally foot conforming having so-called "orthopedic" contours to provide a three dimensional contour which is essentially that of the impression made by the bottom of the foot (the plantar surface) when the foot is in a relaxed or neutral position. Bonded to the dorsal portions of the unit sole is a lightweight upper fabricated from a combination of strong synthetic mesh materials, such as nylon, to provide lightweight support and porosity and leather (which is also porous) to provide support and protection to the dorsal portions of the runner's foot. The anterior portions of the upper provide a comparatively large toe box to accommodate movement of the numerous phalanges, the bones making up the toes, while the anterior portions are strategically reinforced and padded to provide a strong support for the proximal portions of the foot. A full length cushioned insole is disposed over the entire dorsal surface unit sole and it is supplemented by a secondary shock absorber pad or cushion sandwiched between the cushioned insole and sock liner at the anterior portions to provide multiple cushioning of the calcaneus bone, the bone which bears the brunt of the initial heel striking impact of the foot and which bears almost one fourth of the entire body's weight during each step.

The unit sole is lightened to weight and cooled by the provision of a honeycombed internal structure having a plurality of cooling channels which extend beneath the cushioned insole extending to anterior and posterior air ports exposed to the atmosphere.

As an important aspect of the present invention, the unit sole has a unique configuration of its planar surface which in combination with the anatomically contoured dorsal surfaces and the light weight and resiliency of the sole, itself, provided by the sole materials and honeycomb internal structure, accommodates and supports the pronation and supination of the foot by similarly optimallay accommodating flexion and extension of the running shoe about the three body planes (sagittal, dividing the body into right and left hand portions; frontal, dividing the body into front and rear portions; and transverse, dividing the body into upper and lower portions).

More specifically, the configuration of the unit bottom and its cooperative association with the upper readily accommodates abduction and adduction of the foot, namely, movements of the distal part of the foot away or toward the midline of the body. It also readily accommodates dorsiflexion (foot flexion) and plantar flexion (foot extension), movements of the distal part of a foot twoard or away from the front of the leg. Finally, the new running shoe also accommodates inversion and eversion of the foot, movements of the foot or portion thereof, the plantar surfaces of the foot toward or away from the midline of the body. Moreover, the shoe readily accommodates and promotes proper, complex motion of the foot during the stance phase of the running stride when there is a closed kinetic chain of action occurring as the foot structure progressively bears against resistance. Specifically, the motions are "pronation" in which there is adduction and plantarflexion of the talus and calcaneal eversion or there is supination in which there is abduction and dorsiflexion of the talus and calcaneal inversion. Pronation is always accompanied by internal leg rotation and flexion of the knee while supination is always accompanied by external rotation and extension of the knee.

From the foregoing it will be apparent that the design of a satisfactory running shoe is a complex and difficult matter, often involving empirical determinations which best balance and synchronize the complex motions of the foot during running as the 28 bones cycle in complex patterns in biaxial and triaxial motions through supinated, neutral, and pronated positions. The present invention represents a new and improved solution to the problem of providing acceptable, comfortable support to a runner's foot in a shoe manufactured in large numbers, by mass production techniques.

DETAILED DESCRIPTION OF THE PRESENT INVENTION

Figure 1:
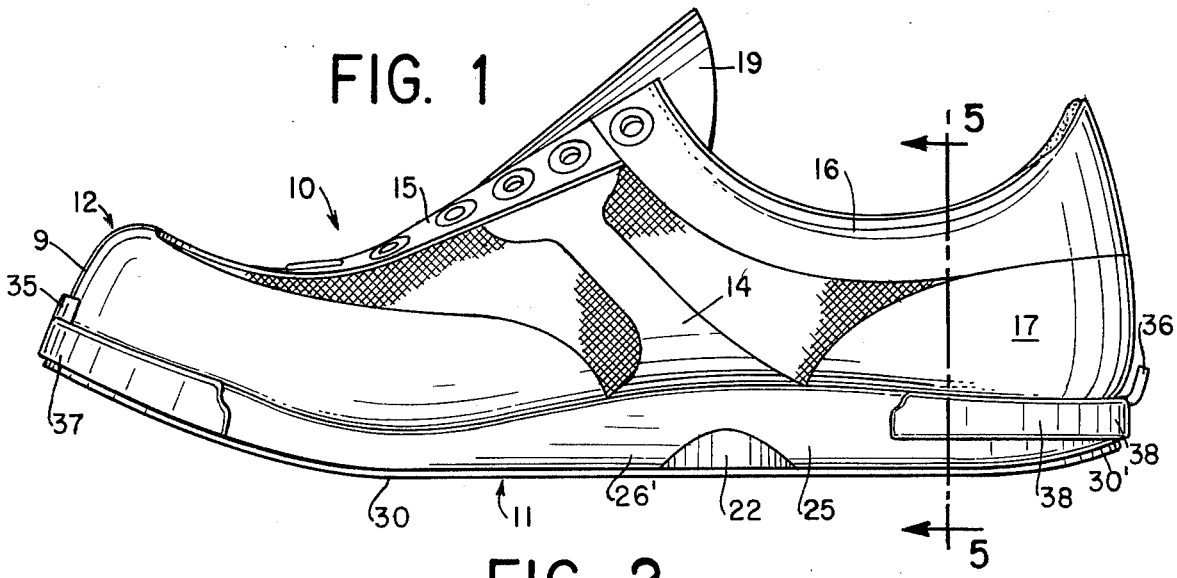
FIG. 1 is a side elevational view of the new running shoe embodying the principles of the present invention. The shoe illustrated is a right shoe and the view is taken from the medial or inside aspect of the foot.
Figure 5:
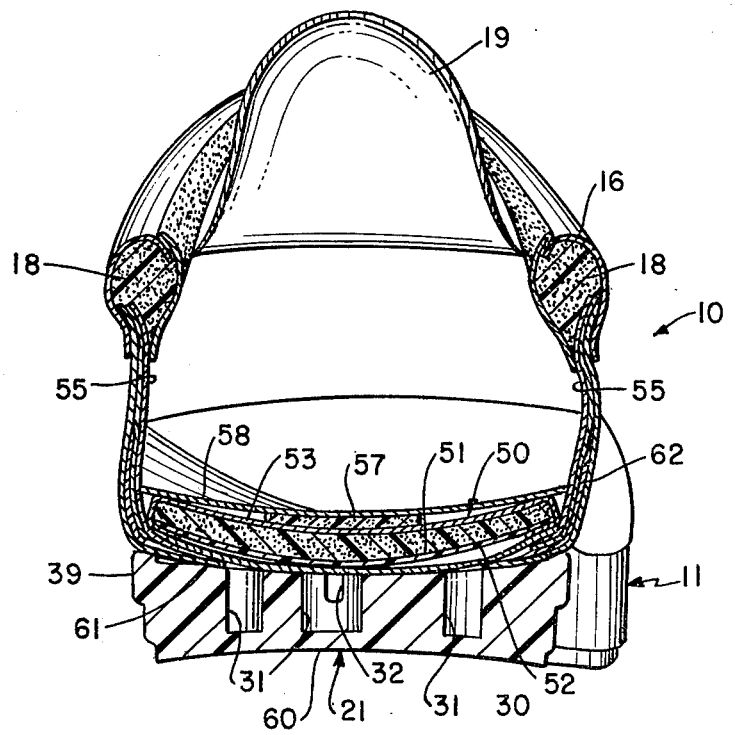
FIG. 5 is a cross-sectional view of the shoe of FIG. 1 taken along line 5—5 thereof.
Figure 6:
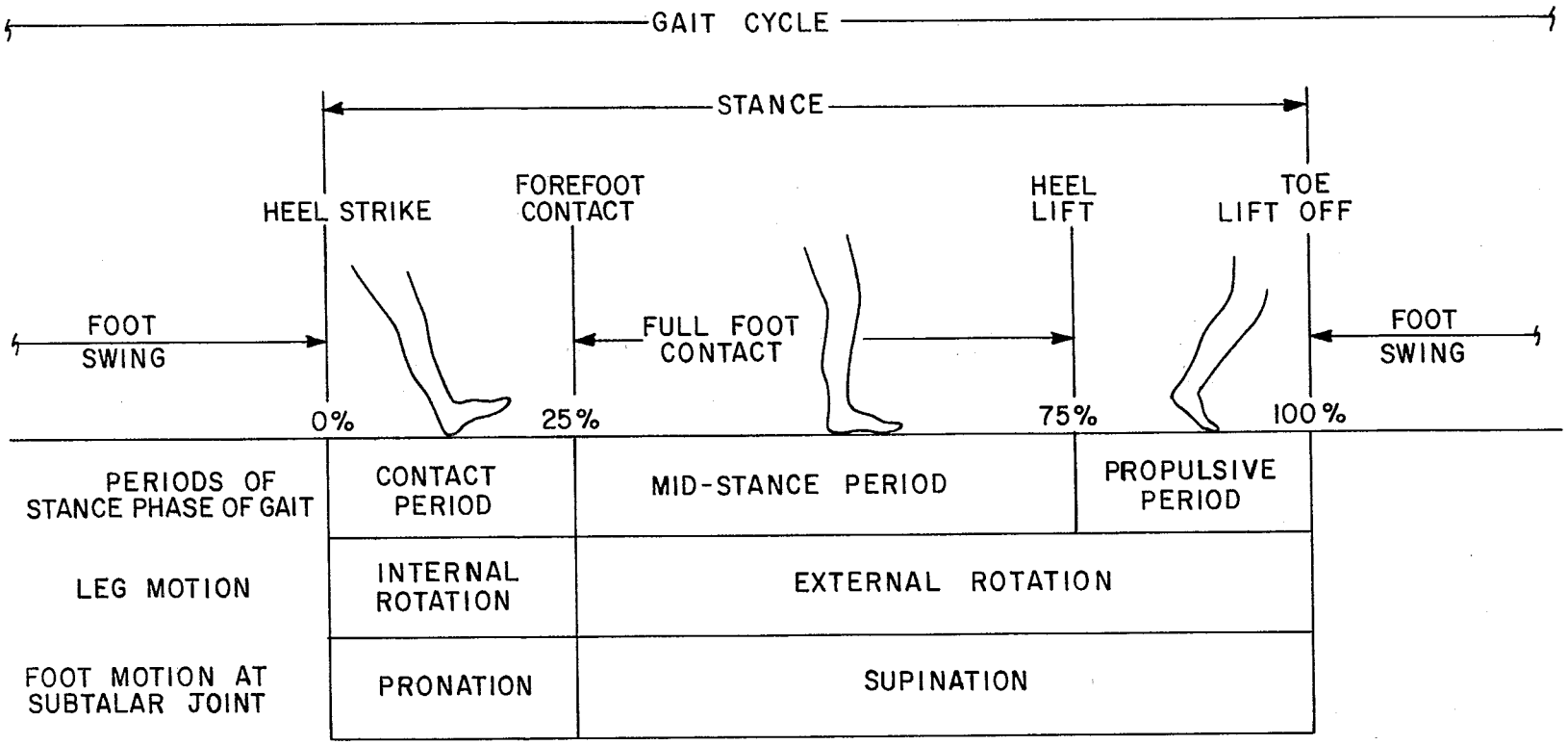
FIG. 6 is a chart schematically illustrating the interrelationship of leg and foot positions and motions during the stance portions of the gait cycle.

Referring now to FIG. 1, the new and improved running shoe of the present invention generally includes a lightweight upper 10 cemented securely to a unit sole 11. The upper 10 includes a leather toe wall 12 extending vertically along the lateral medial edges of the forepart of the shoe and forming a generally squared toebox 9 and a mesh portions forming medial and lateral sidewalls 13 of the upper, which sidewalls 13 are suitably reinforced by leather strips 14 extending from the unit bottom 11 to an elongated eyelet retaining leather strip 15. A foam collar 16 extends from the top of the eyelet strips 15 around and behind the heel portion in a generally U-shaped manner and is common in running shoes of this general type. A leather heel wall or reinforcement 17 is joined to the rearmost portions of the unit bottom to reinforce the upper at the heel portions thereof as will be understood. Advantageously the entire vertical rearwall portion of the upper is leather. As shown in FIG. 5 the collar 16 is lined with expandable thermoplastic foam rubber material 18. The upper also includes a tongue 19 which is interposed between the opposing eyelet strips 15 in well-known manner.

In accordance with one important aspect of the invention, the upper is lasted to a specially configured bottom in a manner whereby the forepart of the bottom 11 is normally disposed at a substantial angle to the flat midpart of the sole to provide an exaggerated or pronounced angle of toe lift or toe spring. Specifically, the unit sole 11 of the present invention is configured, weighted, and balanced to provide optimal support, in combination with the upper, of the bones of the foot in a manner which accommodates and synchronizes the flexion and extension of the shoe body itself with the flexion and extension and rotation of the elements of the foot namely the 28 bones as articulated by the numerous joints, tendons, ligaments and muscles thereof.

Figure 2:
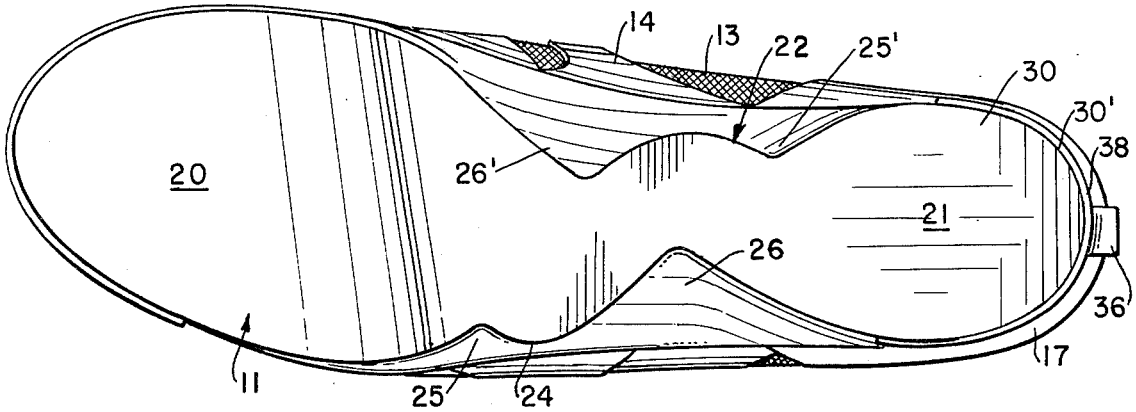
FIG. 2 is a bottom plan view of the shoe of FIG. 1 showing the plantar surfaces of the sole bottom and the merger of the plantar surfaces with the dorsal surfaces of the sole between the heel and forepart portions.
Figure 3:
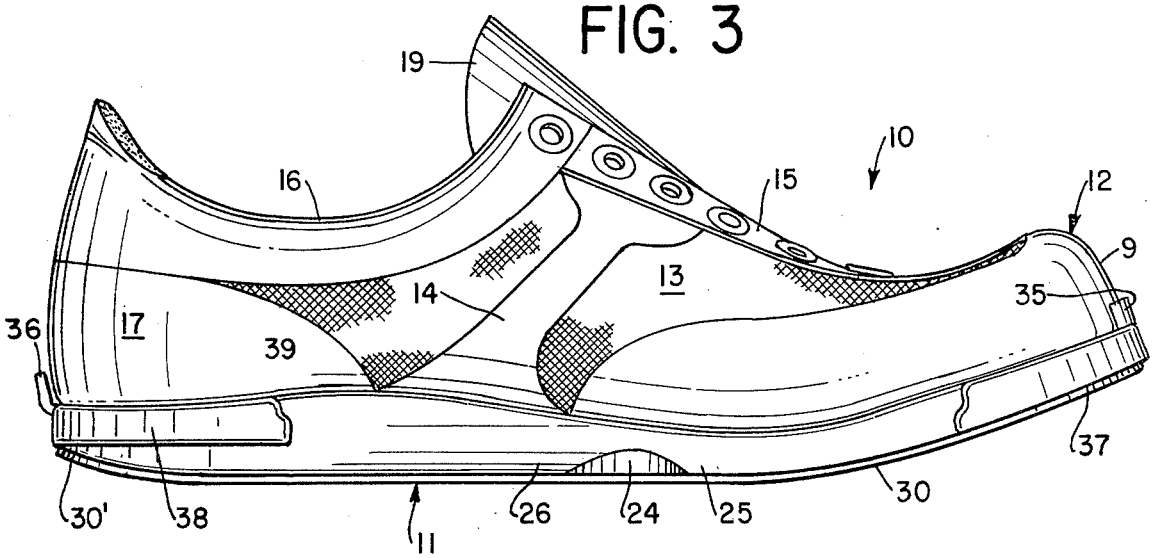
FIG. 3 is a side elevational view of the opposite side of the shoe shown in FIG. 1, namely the view taken from the lateral side (outside) of the new shoe.

To that end, the plantar portions of the sole as shown in FIG. 2 are especially configured, in the manner shown, whereby the forepart portions 20 of the sole are separated from the heel portions of proximal portions of the sole 21 by a unique interconnected set of offset pads namely a medial pad 22, which is generally separated from the posterior and anterior sole portions 20 and 21 respectively by deep and shallow valley portions 26', 25' which extend along the dorsal portions from the sole to the plantar portions, as shown, and a lateral pad 24. The pad 24 is offset along the longitudinal axis of the sole with respect to the medial pad 22. i.e. it is more anteriorly disposed with relation to the unit bottom than is the medial pad 22 which is more posteriorly disposed with respect to the unit bottom. The lateral pad 24 is separated from the forepart 20 by a shallow valley 25 and is separated from the proximal or heel portion 21 by a deeper valley 26. As shown, the lateral pad 24 is generally bounded by the forepart 20, the deep valley 26', the deep valley 26, and the shallow valley 25; whereas the medial pad 22 is bounded by the distal or heel portion 21, the deep valleys 26', 26, and the shallow valley 25'.

As will be appreciated the tread surface of the unit bottom 30 is generally arrayed in somewhat asymmetrical hourglass figure having a narrow throat portion. Specifically, the bottom or plantar surfaces of the medial and lateral pads 22, 24 are arrayed between the much larger forepart portion 20, which is generally oval, and the similarly shaped, but somewhat smaller, oval portion 21 of the heel or proximal portion of the unit bottom 11. This unique configuration of the unit bottom, in which substantial lightness has been achieved along with flexibility and counterbalancing in the area beneath the arch of the foot, provides the finished shoe with an enhanced, desirable degree of flexibility and foot stabilization, all of which accommodates and contributes to the effective and repeated pronation and supination of the foot during running movements. Moreover, to further enhance the effectiveness of the sole, the proximal-most portion thereof is provided with a bevel 30' as shown in FIG. 1, to smooth and to facilitate the heel striking phase of stance. Similarly, the pronounced long and leading forward elevation of the sole facilitates and enhances the toe thrust portion of stance.

Figure 4:
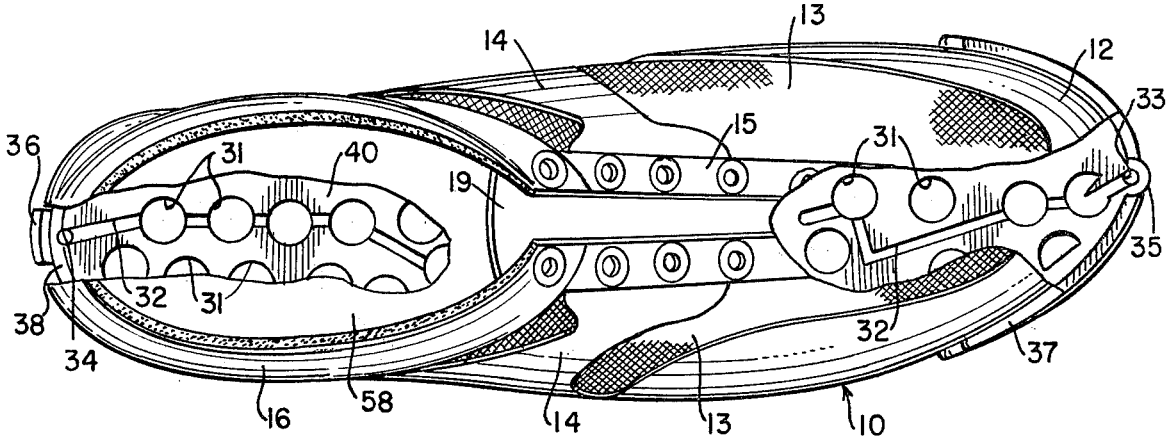
FIG. 4 is a top plan view of the shoe of FIG. 1 with parts broken away to show details of the integral construction of the unit bottom.

More specifically, as shown in FIGS. 4 and 5 the unit bottom 11 is provided with a plurality of lightening holes 31 which, as is well known in the art, reduces the weight of the sole and enhances its flexibility. As indicated in FIG. 4 cooling channels 32 interconnect selected ones of said lightening holes 31 to form cooling networks which terminate respectively at a forwardmost port 33 and a rearwardmost port 34. Similar to the arrangement described in the earlier Famolare U.S. Pat. No. 4,078,321 air enters the ports 33 and 34 and is circulated to the inner portions of the sole through the channels 32. Advantageously and in order to keep the ports 33 and 34 free of contaminants, a semi-circular "chimney"-like dust flap 35 is integrally included with the toe piece 37 of the unit sole and a similarly functioning but slightly differently shaped dust flap 36 is included integrally with the heel piece 38 of the unit sole. The dorsal surfaces of the unit bottom 11 are circumscribed by a lip 39 which receives the upper as shown in FIG. 5. Moreover, the central dorsal surfaces 40 of the unit bottom 11 are configured to correspond anatomically to the plantar portions of the foot of the wearer when it is in its neutral position. This type of "orthopedic" contour of the unit bottom 11, in and of itself is known, and has been described in detail in my aforementioned U.S. Pat. No. 4,078,321. It nevertheless, in combination with the other elements of the unit bottom, represents an important contributing factor to the efficacy of the entire running shoe construction disclosed herein.

Superimposed upon the unit bottom 11 is a full length insole 50 comprising a flat thermoplastic or sponge rubber core 51 sandwiched between a flexible leather bottom layer and a porous, durable, flexible non-woven fabric top layer 53. More specifically and as illustrated in FIG. 5, the top layer 53 is wrapped around the edges of the bottom layer 52 to completely envelop core 51. The insole 50 itself is superimposed over the inturned extremities of the walls of the upper which are cemented by adhesive 61 to the unit bottom, in conventional fashion. Advantageously, the porous non-woven fabric material 53 which covers and forms the upper surface of the insole 50 is also used to line the side walls of the upper as indicated at 55 and it may also be used to line the tongue 19, where desired. The insole 50 extends for the entire length of the shoe and includes a longitudinal arch supporting portion which is contoured to provide additional surface area support beneath the instep or longitudinal arch of the foot of the wearer of the running shoe. Advantageously, a molded leather heel counter 62 is mounted between the heel wall 17 and the lining 55.

To provide extra cushioning beneath the calcaneous of the wearer, a supplementary narrow (less than full width) sponge rubber or thermoplastic cushion 57 is disposed in the posterior portions of the shoe and is secured in place by suitable adhesive to the upper surface 53 of the insole 50. Superimposed upon the cushion 57 is a flexible leather sock liner 58. As will be appreciated, the resilient sponge-like nature of the insole 50 and the flexible sheet materials otherwise making up the layered inner construction of the shoe will conform specifically to the contours of the foot of the wearer and through the anatomically contoured upper surfaces (dorsal) of the unit bottom 11 will provide a maximized support for the entire plantar surface of the wearer's foot. In other words, the entire foot of the wearer will be in intimate, fully supportive, contact with the body of the shoe and will be in general anatomical registration therewith.

In accordance with another specific aspect of the invention, the heel portion 21 of the unit sole 11, as shown in FIG. 5, has a slightly concave contour 60 as viewed through a transverse cross-section taken along line 5—5 of FIG. 1. This, along with the above-described other aspects of the anatomy of the unit bottom 11 contribute to the efficacy of the entire running shoe of the present invention.

The unit bottom 11 of the new shoe is fabricated from thermoplastic rubber material or any other elastomeric materials which may be injection molded into unit soles. For example, "Kraton" (Shell Oil trademark) thermoplastic rubber, a styrene-butadiene block copolymer, described in detail at pages 114–116 of the 1973–1974 Modern Plastics Encyclopedia, the disclosure of which is incorporated by reference herein, is an especially useful resilient material with which to practice the present invention. From the foregoing it will be appreciated that the overall anatomy of the unit bottom 11, including its specific geometry and its honeycombed internal support, is arranged to accommodate and to promote proper flexion and extension of the wearer's foot during pronated and supinated movements of the foot and leg during running and striding, and in particular during the contact, mid-stance, and propulsive periods of the "stance" portion of the runner's gait, i.e. the portion of the gait in which the foot is in contact with the ground.

The shoe construction described herein is intended to be representative only, and certain changes may be made therein without departing from the clear teachings of the disclosure. Accordingly, reference should be made to the following appended claims in determining the full scope of the present invention.

We claim:

1. In a running shoe comprising a unit bottom of elastomeric resilient material, (and) an upper cemented to said bottom, and a full length resilient insole superimposed upon said bottom, the improvement characterized in that (a) the lowermost, ground-contacting, treading portion of said bottom has a generally oval plantar forepart and a generally oval plantar heel part interconnected by a narrow throat portion;

(b) said throat portion comprising a lateral pad and a medial pad;

(c) each of said pads being offset from the longitudinal center line of said bottom;

(d) said lateral pad being disposed anteriorly within said throat portion;

(e) said medial pad being disposed posteriorly within said throat portion;

(f) the dorsal portions of said bottom of said throat portions forming first and second pairs of valleys bounding said lateral and medial pads respectively and separating said oval heel part from said oval forepart, and (g) said first and second pairs of valleys being longitudinally offset from each other.

2. The running shoe of claim 1, further characterized in that (a) said forepart is elevated at an angle with respect to the generally horizontal plane of said heel part and said throat portion, whereby said forepart has substantial toe spring.

3. The running shoe of claim 1, further characterized in that (a) said heel part has a slight transverse concavity.

4. The running shoe of claim 1, further characterized in that (a) the uppermost foot-supporting portions of said unit bottom are generally contoured to conform to the anatomy of the plantar portions of the human foot.

5. The running shoe of claim 1, further characterized in that (a) the posterior-most portions of said heel part are beveled.

6. The running shoe of claim 1, further characterized in that (a) said unit bottom is fabricated from a styrene-butadiene-block copolymer.

7. The running shoe of claim 1, in which (a) said first and second pairs of valleys each include a deep valley and a shallow valley;

(b) said lateral pad is separated from said forepart by a shallow valley and from said heel part by a deep valley; and (c) said medial pad is separated from said forepart by a deep valley and from said heel part by a shallow valley.

8. A running shoe bottom comprising (a) a one-piece molded sole of resilient elastomeric material having a bottom round-indicating tread surface and an upper foot supporting surface;

(b) said bottom has a generally oval plantar forepart and a generally oval plantar heel part interconnected by a narrow throat portion;

(c) said throat portion comprising a lateral pad and a medial pad;

(d) each of said pads being offset from the longitudinal center line of said bottom;

(e) said lateral pad being disposed anteriorly within said throat portion;

(f) said medial pad being disposed posteriorly within said throat portion;

(g) the lowermost portions of said bottom at said throat portions forming first and second pairs of valleys bounding said lateral and medial pads respectively and separating said oval heel part from said oval forepart, and (h) said first and second pairs of valleys being longitudinally offset from each other.

9. The bottom of claim 8, further characterized in that (a) said heel part has a slight transverse concavity.

10. The bottom of claim 8, further characterized in that (a) the uppermost portions of said unit bottom are generally contoured to conform to the anatomy of the plantar portions of the human foot.

11. The bottom of claim 8, further characterized in that (a) the posterior-most portions of said heel part are beveled.

12. The bottom of claim 8, further characterized in that (a) said unit bottom is fabricated from a styrene-butadiene-block copolymer.

13. The bottom of claim 8, further characterized in that (a) said first and second pairs of valleys each include a deep valley and a shallow valley;

(b) said lateral pad is separated from said forepart by a shallow valley and from said heel part by a deep valley; and (c) said medial pad is separated from said forepart by a deep valley and from said heel part by a shallow valley.

* * * * *